US007432867B2

(12) United States Patent
Wang et al.

(10) Patent No.: US 7,432,867 B2
(45) Date of Patent: Oct. 7, 2008

(54) ELECTRONIC DEVICE HAVING DIPOLE ANTENNA

(75) Inventors: Hung-Chih Wang, Kao-Hsiung (TW); Saou-Wen Su, Taipei (TW)

(73) Assignee: Lite-On Technology Corp., Neihu, Taipei (TW)

( * ) Notice: Subject to any disclaimer, the term of this patent is extended or adjusted under 35 U.S.C. 154(b) by 0 days.

(21) Appl. No.: 11/609,310

(22) Filed: Dec. 11, 2006

(65) Prior Publication Data

US 2008/0106479 A1 May 8, 2008

(30) Foreign Application Priority Data

Nov. 7, 2006 (TW) ..... 95219631 U

(51) Int. Cl.
*H01Q 1/24* (2006.01)
*H01Q 9/16* (2006.01)
*H01Q 1/40* (2006.01)

(52) U.S. Cl. ..... 343/702; 343/793; 343/873

(58) Field of Classification Search ..... 343/702, 343/793, 872, 873
See application file for complete search history.

(56) References Cited

U.S. PATENT DOCUMENTS

| | | | | |
|---|---|---|---|---|
| 6,650,301 | B1 * | 11/2003 | Zimmerman | 343/803 |
| 7,126,540 | B2 * | 10/2006 | Hsu et al. | 343/700 MS |
| 2005/0239519 | A1 * | 10/2005 | Saitou et al. | 455/575.1 |
| 2007/0143806 | A1 * | 6/2007 | Pan | 725/111 |
| 2007/0273600 | A1 * | 11/2007 | Tsujimura et al. | 343/787 |

* cited by examiner

*Primary Examiner*—Shih-Chao Chen
(74) *Attorney, Agent, or Firm*—Winston Hsu

(57) ABSTRACT

The present invention provides an electronic device. The electronic device comprises a circuit board; and a dipole antenna, having a first conducting portion and a second conducting portion that are electrically coupled to the circuit board respectively and disposed substantially along an outline of the circuit board.

13 Claims, 4 Drawing Sheets

ELECTRONIC DEVICE HAVING DIPOLE ANTENNA

BACKGROUND OF THE INVENTION

1. Field of the Invention

The present invention relates to an electronic device, and more particularly, to an electronic device having a dipole antenna.

2. Description of the Prior Art

Most digital television (TV) receiving devices in the market utilize an external antenna to receive TV programs, and thus an additional transmission cord for connecting the antenna to the digital TV receiving device is necessary. The additional transmission cord not only consumes excessive space, but also degrades the portability and the appearance of the whole device. Further, frequent attachment/detachment of the transmission cord to/from the digital TV receiving device may cause the problem of contact failure between components of the device. Therefore, it is desired to provide a digital TV antenna that can be disposed inside the digital TV receiving device.

SUMMARY OF THE INVENTION

It is therefore one of the objectives of the present invention to provide an electronic device having a dipole antenna to solve the above mentioned problems.

According to one embodiment of the present invention, the present invention discloses an electronic device, comprising a circuit board and a dipole antenna. The dipole antenna has a first conducting portion and a second conducting portion that are electrically coupled to the circuit board respectively and disposed substantially along an outline of the circuit board.

According to one embodiment of the present invention, an electronic device of the present invention further comprises a housing, wherein the circuit board and the dipole antenna are both disposed in the housing.

According to one embodiment of the present invention, an electronic device of the present invention further comprises a digital television (TV) processing module, disposed on the circuit board and electrically coupled to the dipole antenna, wherein the digital TV processing module receives a digital TV signal through the dipole antenna and processes the received digital TV signal.

According to one embodiment of the present invention, an electronic device of the present invention further comprises a hot-swapping interface, electrically coupled to the circuit board. Additionally, an electronic device of the present invention further comprises a digital TV processing module, disposed on the circuit board and electrically coupled between the dipole antenna and the hot-swapping interface, wherein the digital TV processing module receives a digital TV signal through the dipole antenna, processes the received digital TV signal, and outputs the processed digital TV signal through the hot-swapping interface.

According to one embodiment of the present invention, an electronic device of the present invention further comprises a plug-and-play interface, electrically coupled to the circuit board. Additionally, an electronic device of the present invention further comprises a digital TV processing module, disposed on the circuit board and electrically coupled between the dipole antenna and the plug-and-play interface, wherein the digital TV processing module receives a digital TV signal through the dipole antenna, processes the received digital TV signal, and outputs the processed digital TV signal through the plug-and-play interface.

According to one embodiment of the present invention, in an electronic device of the present invention, the first conducting portion and the second conducting portion of the dipole antenna are a pair of metal radiators.

According to one embodiment of the present invention, in an electronic device of the present invention, a shape of the first conducting portion of the dipole antenna and that of the second conducting portion of the dipole antenna are substantially symmetrical to each other.

According to one embodiment of the present invention, in an electronic device of the present invention, the first conducting portion and the second conducting portion of the dipole antenna are directly connected to a first point and a second point of the circuit board, the first point is a signal feed point of the dipole antenna, and the second point is a ground point of the dipole antenna. Additionally, in an electronic device of the present invention, the outline of the circuit board at least has a first side, a third side, and a fourth side, the third side is opposite to the fourth side, the first point and the second point are adjacent to the first side, the first conducting portion substantially extends upwards from the first point of the circuit board, then extends along the first side in a first direction, and finally extends along the third side in a third direction, and the second conducting portion substantially extends upwards from the second point of the circuit board, then extends along the first side in a second direction, and finally extends along the fourth side in a fourth direction. Moreover, the first direction and the second direction are substantially in opposite directions, and the third direction and the fourth direction are substantially in the same direction. Furthermore, when the first conducting portion extends along the first side in the first direction, the first conducting portion is substantially parallel with the first side. When the first conducting portion extends along the third side in the third direction, the first conducting portion is substantially parallel with the third side. When the second conducting portion extends along the first side in the second direction, the second conducting portion is substantially parallel with the first side. When the second conducting portion extends along the fourth side in the fourth direction, the second conducting portion is substantially parallel with the fourth side.

According to one embodiment of the present invention, an electronic device of the present invention is a portable multimedia player, a portable memory device, or a mouse.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
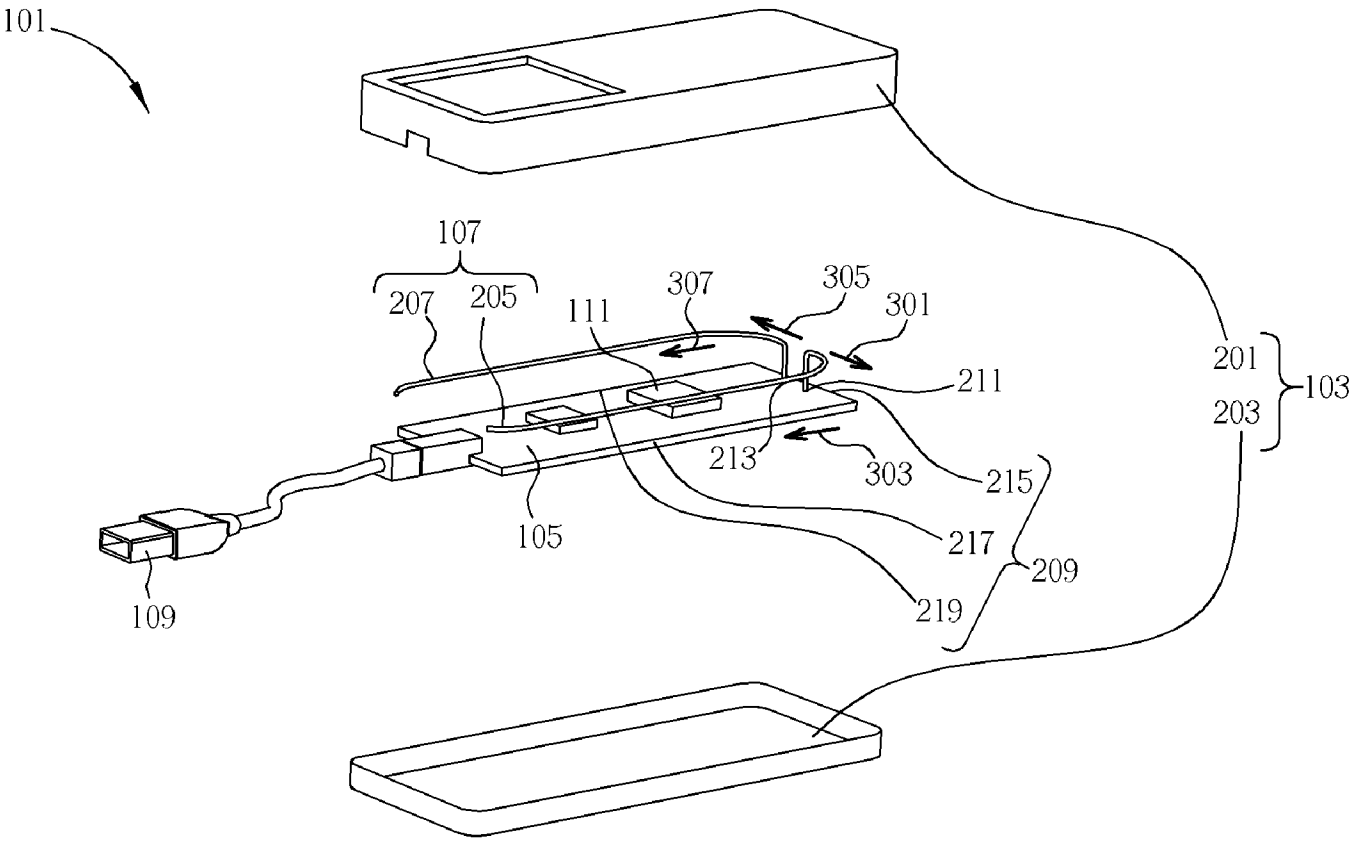
FIG. 1 is a three-dimensional diagram illustrating an electronic device according to an embodiment of the present invention, wherein an upper housing and a lower housing of the electronic device are separated so as to show an inner structure of the electronic device.

Please refer to FIG. 1. FIG. 1 is a three-dimensional diagram illustrating an electronic device 101 according to an embodiment of the present invention, wherein an upper housing 201 and a lower housing 203 of the electronic device 101 are separated so as to show an inner structure of the electronic device 101. In this embodiment, the electronic device 101 is a portable multimedia player capable of receiving digital television (TV) programs. As shown in FIG. 1, the electronic device 101 comprises a housing 103, a circuit board 105, a dipole antenna 107, a hot-swapping interface 109, and a digital TV processing module 111.

The housing 103 has an upper housing 201 and a lower housing 203. When normally used, the upper housing 201 and the lower housing 203 are combined together to form a complete housing 103. In FIG. 1, however, the upper housing 201 and the lower housing 203 of the electronic device 101 are separated so as to show the inner structure of the electronic device 101.

Figure 4:
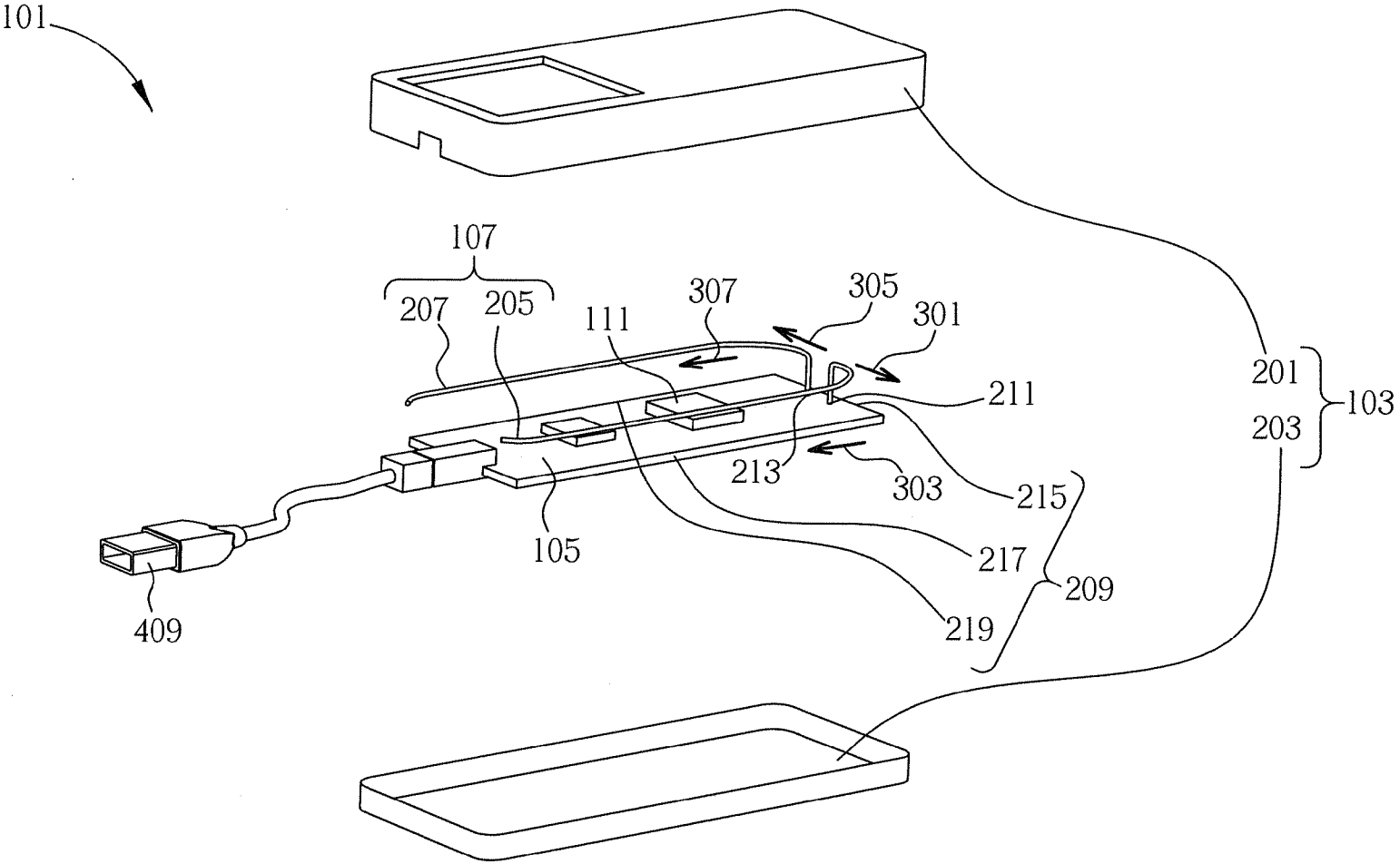
FIG. 4 is a three-dimensional diagram illustrating a USB electronic device according to an embodiment of the present invention, wherein an upper housing and a lower housing of the USB electronic device are separated so as to show an inner structure of the electronic device.

The hot-swapping interface 109 is electrically coupled to the circuit board 105. In this embodiment, the hot-swapping interface 109 is a universal serial bus interface (USB interface). In another embodiment, however, the hot-swapping interface 109 may be replaced by a plug-and-play interface 409, as shown in FIG. 4. Please note that the USB interface can both indicate a hot-swapping interface 109 and a plug-and-play interface 409, as well known. The digital TV processing module 111 is disposed on the circuit board 105 and electrically coupled between the dipole antenna 107 and the hot-swapping interface 109. Therefore, the digital TV processing module 111 can receive a digital TV signal through the dipole antenna 107, processes the received digital TV signal, and then outputs the processed digital TV signal through the hot-swapping interface 109. Additionally, in this embodiment, while a user of the electronic device 101 watches digital TV programs, the user can still operate the multimedia functions of the electronic device 101.

The dipole antenna 107 is disposed in the housing 103 and has a first conducting portion 205 and a second conducting portion 207. As shown in FIG. 1, the first conducting portion 205 and the second conducting portion 207 are electrically coupled to the circuit board 105 respectively. Further, the first conducting portion 205 and the second conducting portion 207 are disposed substantially along an outline 209 of the circuit board 105. The first conducting portion 205 and the second conducting portion 207 are a pair of metal radiators. In other words, the dipole antenna 107 is a half-wave dipole antenna. Additionally, the first conducting portion 205 and the second conducting portion 207 of the dipole antenna 107 can provide a mirror current to each other, thereby forming a closed loop of electromagnetic field (EMF) in the dipole antenna 107. Therefore, the dipole antenna 107 can have a satisfying impedance bandwidth by properly adjusting a distance between the first conducting portion 205 and the second conducting portion 207.

The shape of the first conducting portion 205 and that of the second conducting portion 207 are substantially symmetrical to each other. Further, the first conducting portion 205 and the second conducting portion 207 are directly connected to a first point 211 and a second point 213 of the circuit board 105. The first point 211 is a signal feed point of the dipole antenna 107, and the second point 213 is a ground point of the dipole antenna 107.

The circuit board 105 is disposed in the housing 103. As shown in FIG. 1, the outline 209 of the circuit board 105 at least has a first side 215, a third side 217, and a fourth side 219, and the third side 217 is opposite to the fourth side 219. The first point 211 and the second point 213 are adjacent to the first side 215. The first conducting portion 205 substantially extends upwards from the first point 211 of the circuit board 105, then extends along the first side 215 in a first direction 301, and finally extends along the third side 217 in a third direction 303. Similarly, the second conducting portion 207 substantially extends upwards from the second point 213 of the circuit board 105, then extends along the first side 215 in a second direction 305, and finally extends along the fourth side 219 in a fourth direction 307. Further, the first direction 301 and the second direction 305 are substantially in opposite directions, and the third direction 303 and the fourth direction 307 are substantially in the same direction.

Moreover, when the first conducting portion 205 extends along the first side 215 in the first direction 301, the first conducting portion 205 is substantially parallel with the first side 215. When the first conducting portion 205 extends along the third side 217 in the third direction 303, the first conducting portion 205 is substantially parallel with the third side 217. Similarly, when the second conducting portion 207 extends along the first side 215 in the second direction 305, the second conducting portion 207 is substantially parallel with the first side 215. When the second conducting portion 207 extends along the fourth side 219 in the fourth direction 307, the second conducting portion 207 is substantially parallel with the fourth side 219. Because the first conducting portion 205 and the second conducting portion 207 of the dipole antenna 107 extends along two longer sides (i.e. the third side 217 and the fourth side 219) of the circuit board 105 in a parallel style, impedance between the dipole antenna 107 and a system ground can be greatly decreased.

Figure 2:
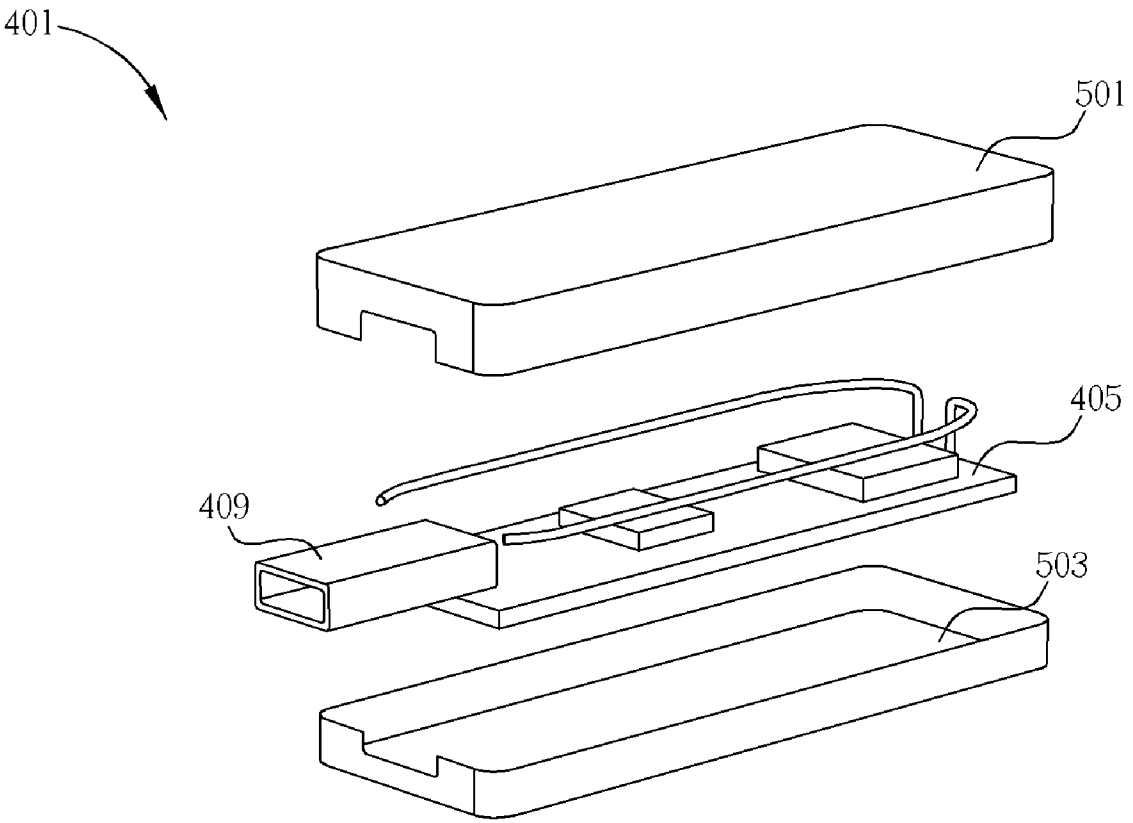
FIG. 2 is a three-dimensional diagram illustrating an electronic device according to another embodiment of the present invention, wherein an upper housing and a lower housing of the electronic device are separated so as to show an inner structure of the electronic device.

Please refer to FIG. 2. FIG. 2 is a three-dimensional diagram illustrating an electronic device 401 according to another embodiment of the present invention, wherein an upper housing 501 and a lower housing 503 of the electronic device 401 are separated so as to show an inner structure of the electronic device 401. In this embodiment, the electronic device 401 is a portable memory device capable of receiving digital TV programs. The electronic device 401 and the electronic device 101 are substantially the same in structure and technical characteristics related to the disclosed principles of the present invention. The main distinction lies in that the electronic device 401 has a different upper housing 501, a different lower housing 503, and different functions related to a portable memory device from those of the electronic device 101. Moreover, in this embodiment, a hot-swapping interface 409 is directly connected to a circuit board 405.

Figure 3:
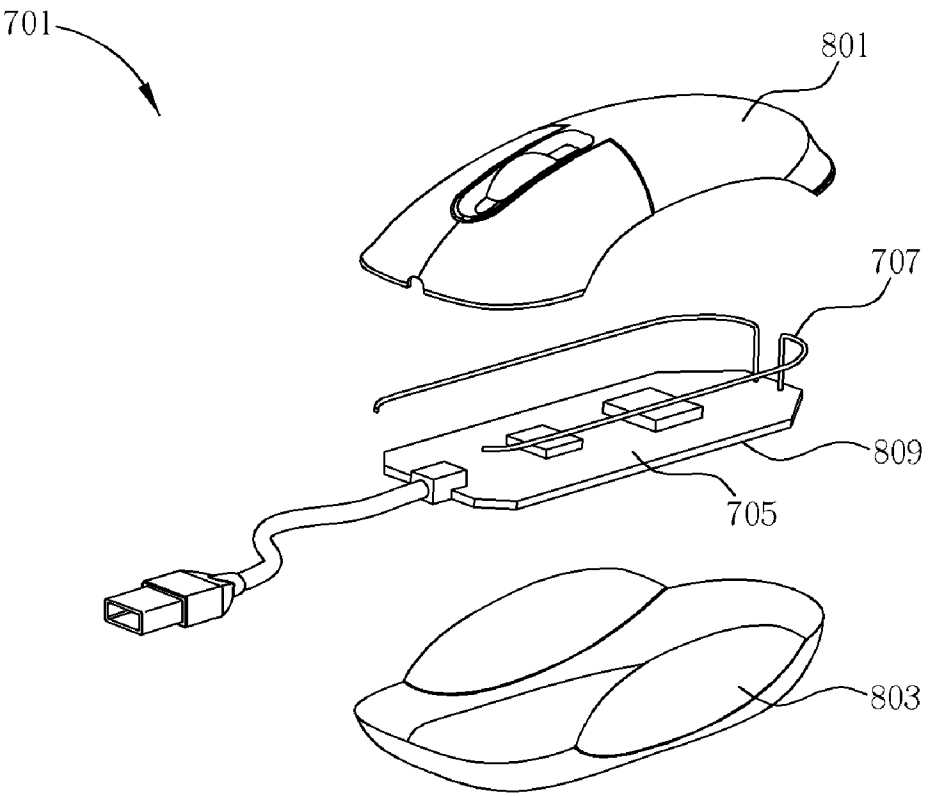
FIG. 3 is a three-dimensional diagram illustrating an electronic device according to still another embodiment of the present invention, wherein an upper housing and a lower housing of the electronic device are separated so as to show an inner structure of the electronic device.

Please refer to FIG. 3. FIG. 3 is a three-dimensional diagram illustrating an electronic device 701 according to still another embodiment of the present invention, wherein an upper housing 801 and a lower housing 803 of the electronic device 701 are separated so as to show an inner structure of the electronic device 701. In this embodiment, the electronic device 701 is a mouse capable of receiving digital TV programs. The electronic device 701 and the electronic device 101 are substantially the same in structure and technical characteristics related to the disclosed principles of the present invention. The main distinction lies in that the electronic device 701 has a different upper housing 801, a different lower housing 803, and different functions related to a mouse from those of the electronic device 101. Although a circuit board 705 of the electronic device 701 is an octagon, this embodiment still follows the disclosed principles of the present invention in which a dipole antenna 707 is disposed substantially along an outline 809 of the circuit board 705.

In the present invention, the dipole antenna for receiving digital TV signals is disposed substantially along the outline of the circuit board inside the housing of the electronic device, so the overall dimension of the electronic device need not be changed, and the appearance of the whole electronic device can remain the same. Additionally, using the electronic device of the present invention, the user can watch digital TV programs and operate other functions, such as multimedia functions, memory functions, or mouse functions, at the same time. The internal dipole antenna of the present invention can expand the functions of the electronic device. Moreover, using the electronic device of the present invention, the user need not carry any external antenna or transmission cord, thereby improving convenience greatly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electronic device, comprising:

a circuit board; and a dipole antenna, having a first conducting portion and a second conducting portion that are electrically coupled to the circuit board respectively and disposed substantially along and above an outline of the circuit board;

wherein the outline of the circuit board at least has a first side, a third side, and a fourth side, the third side is opposite to the fourth side, the first point and the second point are adjacent to the first side, the first conducting portion substantially extends upwards from the first point of the circuit board, then extends along the first side in a first direction, and finally extends along the third side in a third direction, and the second conducting portion substantially extends upwards from the second point of the circuit board, then extends along the first side in a second direction, and finally extends along the fourth side in a fourth direction.

2. The electronic device of claim 1, further comprising:

a housing;

wherein the circuit board and the dipole antenna are both disposed in the housing.

3. The electronic device of claim 1, further comprising:

a digital television (TV) processing module, disposed on the circuit board and electrically coupled to the dipole antenna, wherein the digital TV processing module receives a digital TV signal through the dipole antenna and processes the received digital TV signal.

4. The electronic device of claim 1, further comprising:

a hot-swapping interface, electrically coupled to the circuit board.

5. The electronic device of claim 4, further comprising:

a digital TV processing module, disposed on the circuit board and electrically coupled between the dipole antenna and the hot-swapping interface, wherein the digital TV processing module receives a digital TV signal through the dipole antenna, processes the received digital TV signal, and outputs the processed digital TV signal through the hot-swapping interface.

6. The electronic device of claim 1, further comprising: a plug-and-play interface, electrically coupled to the circuit board.

7. The electronic device of claim 6, further comprising:

a digital TV processing module, disposed on the circuit board and electrically coupled between the dipole antenna and the plug-and-play interface, wherein the digital TV processing module receives a digital TV signal through the dipole antenna, processes the received digital TV signal, and outputs the processed digital TV signal through the plug-and-play interface.

8. The electronic device of claim 1, wherein the first conducting portion and the second conducting portion are a pair of metal radiators.

9. The electronic device of claim 1, wherein a shape of the first conducting portion and that of the second conducting portion are substantially symmetrical to each other.

10. The electronic device of claim 1, wherein the first conducting portion and the second conducting portion are directly connected to a first point and a second point of the circuit board, the first point is a signal feed point of the dipole antenna, and the second point is a ground point of the dipole antenna.

11. The electronic device of claim 1, wherein the first direction and the second direction are substantially in opposite directions, and the third direction and the fourth direction are substantially in the same direction.

12. The electronic device of claim 1, wherein when the first conducting portion extends along the first side in the first direction, the first conducting portion is substantially parallel with the first side; when the first conducting portion extends along the third side in the third direction, the first conducting portion is substantially parallel with the third side; when the second conducting portion extends along the first side in the second direction, the second conducting portion is substantially parallel with the first side; and when the second conducting portion extends along the fourth side in the fourth direction, the second conducting portion is substantially parallel with the fourth side.

13. The electronic device of claim 1, wherein the electronic device is a portable multimedia player, a portable memory device, or a mouse.

* * * * *